US005335432A

United States Patent [19]

Simpson

[11] Patent Number: 5,335,432

[45] Date of Patent: Aug. 9, 1994

[54] IRONING BOARD WITH LEG LOCKING MEMBER AND HANGER ATTACHMENT

[75] Inventor: Danny Simpson, Seymour, Ind.

[73] Assignee: Seymour Housewares Corporation, Seymour, Ind.

[21] Appl. No.: 85,327

[22] Filed: Jun. 30, 1993

Related U.S. Application Data

[62] Division of Ser. No. 911,671, Jul. 9, 1992, Pat. No. 5,272,825.

[51] Int. Cl.[5] ..... D06F 81/04; A47B 9/16

[52] U.S. Cl. ..... 38/106; 38/137; 38/DIG. 3; 108/120

[58] Field of Search ..... 38/103, 104, 106, 66, 38/137, 140, DIG. 1, DIG. 2, DIG. 3; 108/42, 117, 118, 120; 211/86; 248/51

[56] References Cited

U.S. PATENT DOCUMENTS

| | | | |
|---|---|---|---|
| 1,359,527 | 11/1920 | Reed | 108/117 X |
| 2,424,734 | 7/1947 | Booth | 38/137 X |
| 2,579,062 | 12/1951 | Aab | 248/51 |
| 2,854,148 | 9/1958 | Mattos et al. | 211/86 |
| 2,896,347 | 7/1959 | Hortman, Jr. | 38/DIG. 3 |
| 2,974,431 | 3/1961 | Ribaudo | 38/103 |
| 3,435,957 | 4/1969 | Lloyd | 38/106 |
| 4,525,942 | 7/1985 | Azzara | 38/106 |
| 4,821,650 | 4/1989 | Simpson | 108/120 |

FOREIGN PATENT DOCUMENTS

| | | | |
|---|---|---|---|
| 1276320 | 10/1961 | France . | |
| 2399818 | 4/1979 | France . | |
| 0611268 | 10/1948 | United Kingdom | 38/137 |
| 0769489 | 3/1957 | United Kingdom | 38/106 |
| 2124661 | 2/1984 | United Kingdom | 38/103 |

*Primary Examiner*—Clifford D. Crowder
*Assistant Examiner*—Ismael Izaguirre
*Attorney, Agent, or Firm*—King & Schickli

[57] ABSTRACT

An adjustable ironing table (11) includes a top board (12) and collapsible legs (14,16). The legs are retained in a stored position by a lock mechanism (60) that has a lock plate (68) spring biased to a locking position. A handle (72) can be operated to release the lock plate (68). The top board (12) has a mesh section (30) that has a stepped periphery (32) welded to a flange section (36) of a tubular frame member (35). The ends (37) of the frame member are affixed together by a bracket (41) welded to each end. A hanger rail (90) is pivotably mounted under the frame (34) to move between a stored position and a usable position. A pair of cord elevation devices (114) are mounted to the hanger rail (90).

7 Claims, 5 Drawing Sheets

IRONING BOARD WITH LEG LOCKING MEMBER AND HANGER ATTACHMENT

This is a divisional application of U.S. Ser. No. 911,671 filed Jul. 9, 1992, now U.S. Pat. No. 5,272,825.

BACKGROUND OF THE INVENTION

1. Technical Field

The field of this invention relates to ironing boards or tables of adjustable height and more particularly, the construction of the locking mechanism and the fabrication of the top portion of the table to provide for various attachments.

2. Background Information

Ironing boards generally include legs pivotally connected together. The legs have their upper ends attached to a top board. The top of at least one leg is in sliding engagement with the top board. The legs generally pivot to lie against the board in a stored or folded position and pivot to allow the distal ends of the legs to move away from the top board to an unfolded or usable position. A lock mechanism can adjustably lock the legs to set the board at a desired height.

The known lock mechanisms merely prevent the legs from unfolding. The legs are free to abut and knock against the frame of the top board. Consequently, the legs often have its paint coating chipped off and may even be dented due to the knocking against the frame resulting in a less attractive ironing board.

The advent of steam irons made mesh boards popular because mesh tops provides a porous surface through which the steam from the iron can easily penetrate. The mesh is supported along its periphery by being welded to a peripheral frame member. The frame member is commonly a u-shaped bracket or a tubular member. Tubular frame members are desired because they are stronger that u-shaped and other types of frame members. When the frame member is of tubular construction for added strength, the known mesh tops have the periphery welded on top of the frame member leaving the peripheral edge of the mesh exposed. The exposed edges are often sharp and may scratch or cut material that comes in contact with it.

It is also known to provide ironing boards with accessories such as garment supports for hanging a freshly ironed garment or an attachment for retaining the iron electric cord in an elevated position. Brackets for attaching shelves or other storage accessories are also known to be incorporated into an ironing board.

What is needed is a new tubular frame construction that provides for an improved connection to the mesh material. What is also needed is an improved lock mechanism that eliminates the denting and chipping of the legs against the frame member. Furthermore, improved attachments are also desired to elevate the iron electric cord and store freshly ironed clothes.

SUMMARY OF THE DISCLOSURE

In accordance with one aspect of the invention, an ironing board platform has a mesh top with a central section having a plurality of apertures therethrough and a periphery. A peripheral frame member is made from a tubular element with an inwardly extending horizontally disposed flange section having a lower surface and upper surface defining a thickness of said flange. The periphery of the mesh top is stepped down approximately a distance equal to the thickness of the flange section and connected to the lower surface of the flange. The upper surface of the flange is substantially aligned with an upper surface of the mesh top.

Preferably, the frame member has two distal ends opposing each other. A bracket is shaped to abut the outer surfaces of the frame member and spans a gap between the distal opposing ends. The bracket is affixed to the outer surfaces adjacent each distal end. The bracket has an upper section extending over the mesh central section and being affixed thereto.

According to another aspect of the invention, an adjustable ironing table has first and second legs moveable between a collapsed stored position adjacent a top board and an open extended position. The first and second legs are pivotable with respect to each other about a pivot axle between the collapsed stored position and the open extended position. An elongated control element is connected to one of the legs and slideably connected to the top board. A lock member interacts with the control element and is moveable between a first release position which allows the legs to move toward either the collapsed stored position or the open extended position and a second lock position which prevents the legs from moving toward the collapsed stored position. The plate member has a section engaging the pivot axle when the legs are in the collapsed stored position and when the plate member is in the second lock position to prevent the legs from moving toward the open extended position. The lock plate member has a second section engaged with the axle to define the collapsed position and prevents the legs from further collapsing and from abutting the top board.

Preferably, the lock plate member includes a lower flange section abuttable against a lower portion of the axle to prevent the legs from moving toward the open extended position when the legs are in the collapsed stored position and when the plate member is in the second lock position. The lock plate member includes an upper flange section abuttable against an upper portion of said axle to prevent the legs from further collapsing and preventing its distal sections from abutting the top board.

According to another aspect of the invention, an adjustable ironing table has first and second legs moveable between a collapsed stored position adjacent a top board and an open extended position. A hanger rail has at least one lower leg section pivotably connected to the ironing table under the top board. The lower leg section is pivotable about an axis that is approximately perpendicular to a longitudinal axis of the top board and parallel to a plane surface of the top board. The hanger rail has a hanging rail section affixed to the leg section for moving between a stored position adjacent to the top board and a usable position positioned beyond an end edge of the top board. A stop device is positioned under the top board operably connected to the leg section for providing a limit stop for the leg section when the hanging rail section is in the usable section.

The stop device includes a bracket affixed to the leg section and extending approximately perpendicular away from the pivot axis. A distal end of the bracket is abuttable against a longitudinally extending channel rail affixed under the top board.

A cord elevation device is mounted in proximity to the hanging rail section and is sized to slidably receive an electric cord of an iron. The cord elevation device includes a loop element affixed to a side of the hanging rail section. The loop element has a slot sized to allow an electric cord of and iron to be squeezed therethrough. The loop element has a central aperture sized to slidably receive said electric cord. Preferably, a cord elevation device is affixed to each end of said hanging rail section.

BRIEF DESCRIPTION OF THE DRAWINGS

Reference now is made to the accompanying drawings in which.

DESCRIPTION OF THE PREFERRED EMBODIMENT

Figures 1, 2A:
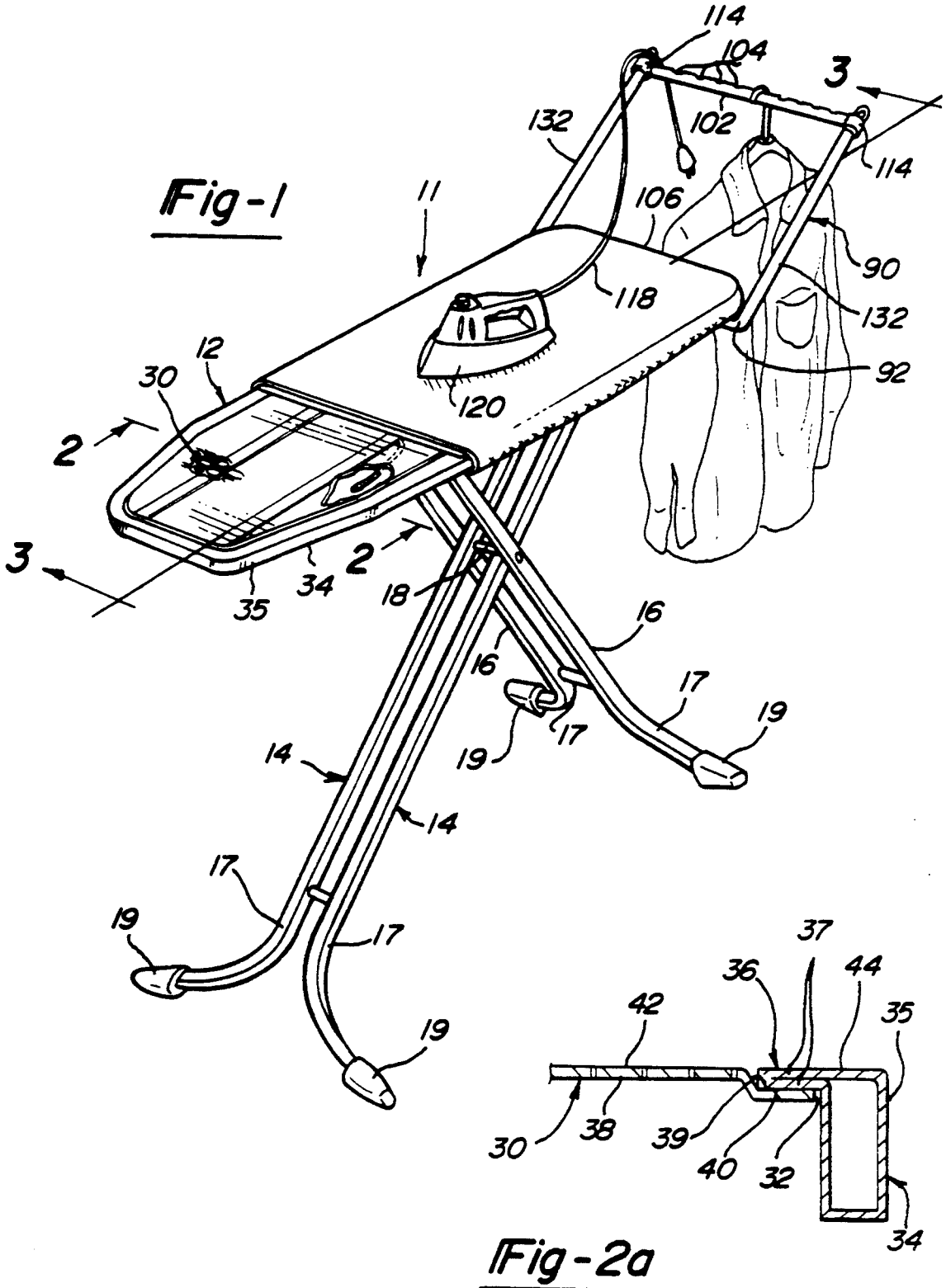
FIG. 1 is a perspective and partially segmented view of an ironing board constructed in accordance with the present invention.
FIG. 2*a* is an enlarged view similar to FIG. 2 illustrating the connection of the mesh to the frame.
Figures 3, 6:
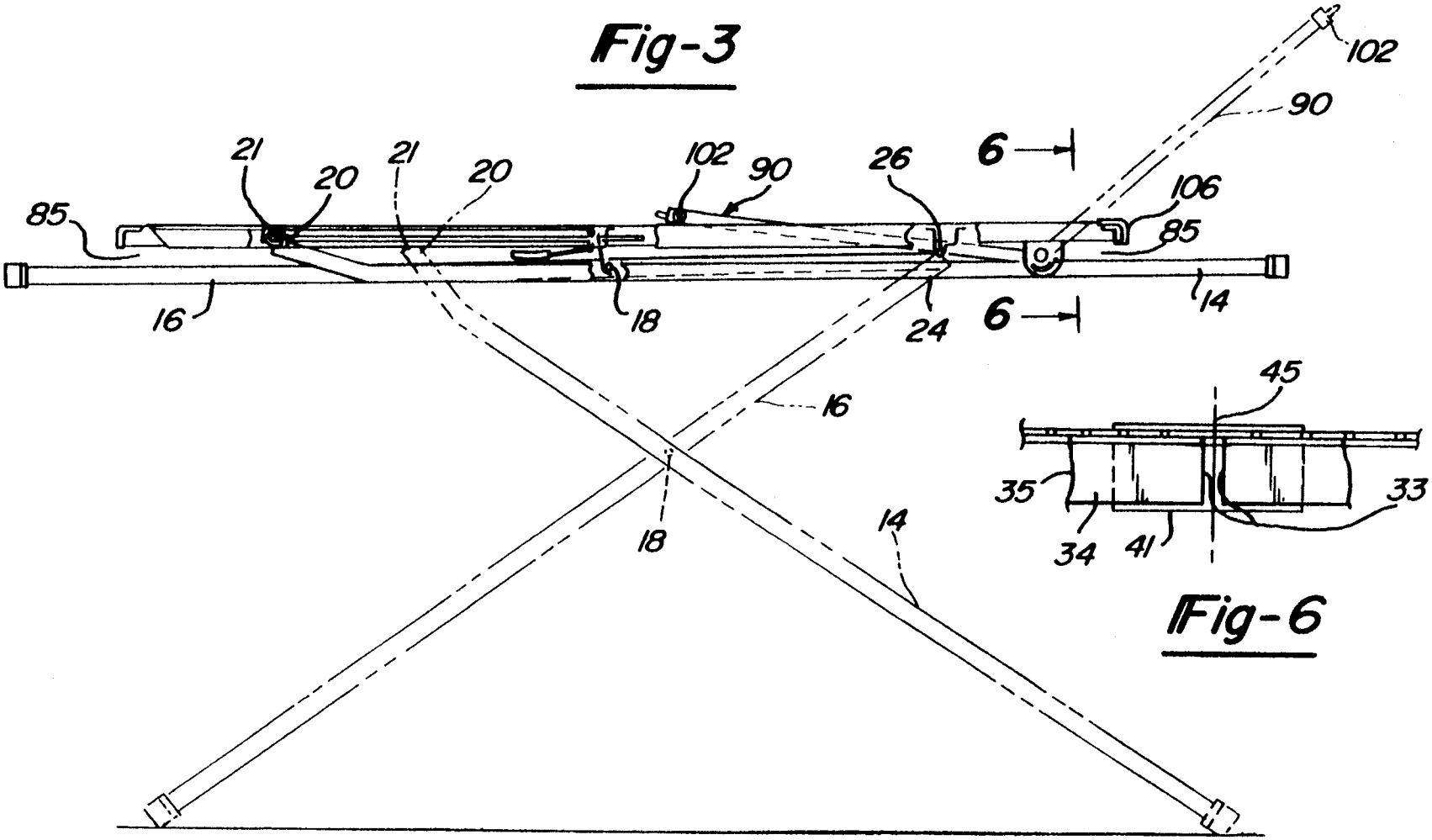
FIG. 3 is a cross-sectional view taken along line 3—3 shown in FIG. 1 illustrating the legs in both the closed stored position and an open position.
FIG. 6 is a cross-sectional view taken along line 6—6 shown in FIG. 3.

Referring now to FIG. 1, an ironing table 11 includes a top board 12, a first pair of legs 14, and a second pair of legs 16. The legs 14 are pivotably connected to legs 16 via an axle 18. The legs 14 has their top end 20 connected to an axle 21 that is pivotably mounted to plastic slides 23 that slide in a channel 22 formed by channel walls 25. Legs 16 have their top end 24 affixed to an axle 26 so that they only pivot with respect to top board 12. The sliding and pivoting of legs 14 and 16 provide movement of the legs 14 and 16 between an open position and a collapsed or stored position as illustrated in FIG. 3. The distal sections 17 of the legs 14 and 16 end with splayed feet 19 for standing on a floor or similar surface.

Figure 2:
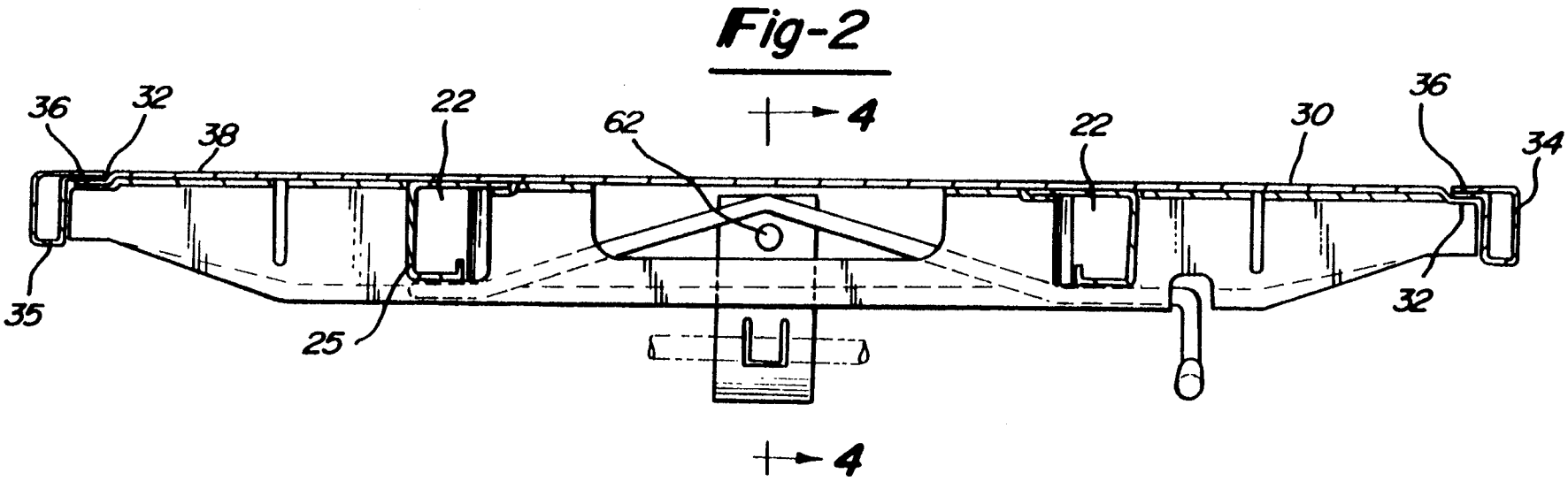
FIG. 2 is an enlarged cross-sectional view taken along line 2—2 shown in FIG. 1.

The top board 12 has a mesh 30 welded at its periphery 32 to a flange 36 of frame 34. The frame 34 is formed from a tubular member 35 for strength and durability. The flange 36 is an integral part of the tubular member and is formed from two integral walls 37 of the tubular member being pinched together at an inside upper section of the frame 34. As clearly shown in FIGS. 2, 2*a*, and 8, the periphery 32 is stepped down from a center section 38 of the mesh 30 a distance approximately equal to the thickness of flange 36 such that the top surface 39 of the periphery abuts and is welded to the lower surface 40 of flange 36 and the top surface 42 of the center section 38 is horizontally aligned with the top surface 44 of frame 34.

Figure 8:
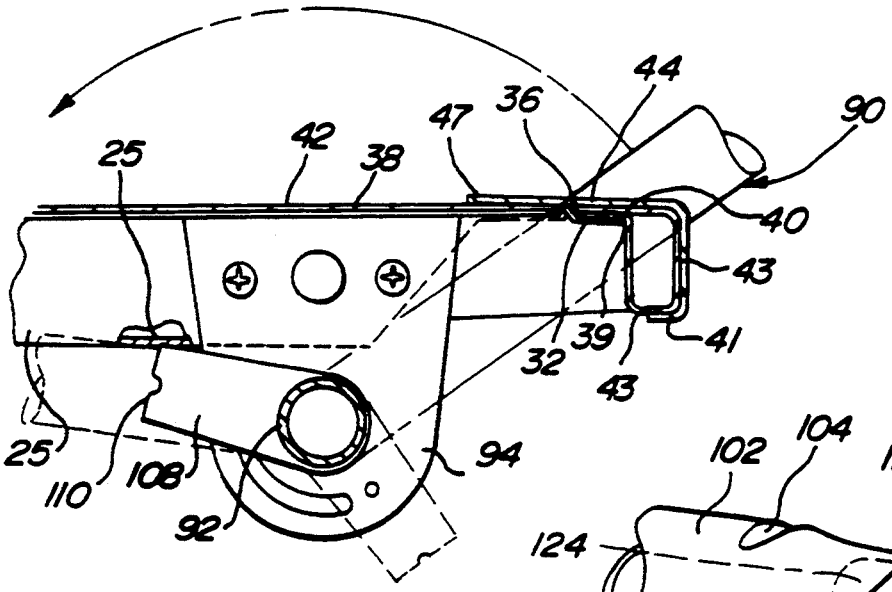
FIG. 8 is a fragmentary side elevational view illustrating the hanger rail in a stored and open position.
Figure 9:
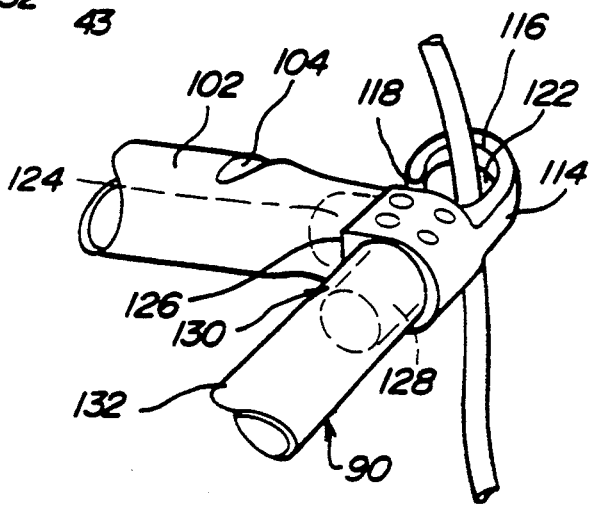
FIG. 9 is an enlarged fragmentary view illustrating the electric cord holder.

The tubular member 35 has two opposing distal ends 33. A bracket member 41 abuts and is welded to the lower surface 53, outer surface 43 and top surface 44 of the frame 34 at the two opposing ends 33 and spans the gap 45 therebetween as shown in FIG. 8. The bracket member 41 has a top extension 47 that is welded to the top surface 42 of mesh 30. The bracket member 41 provides a strong closure that is cosmetically desirable.

Figure 10:
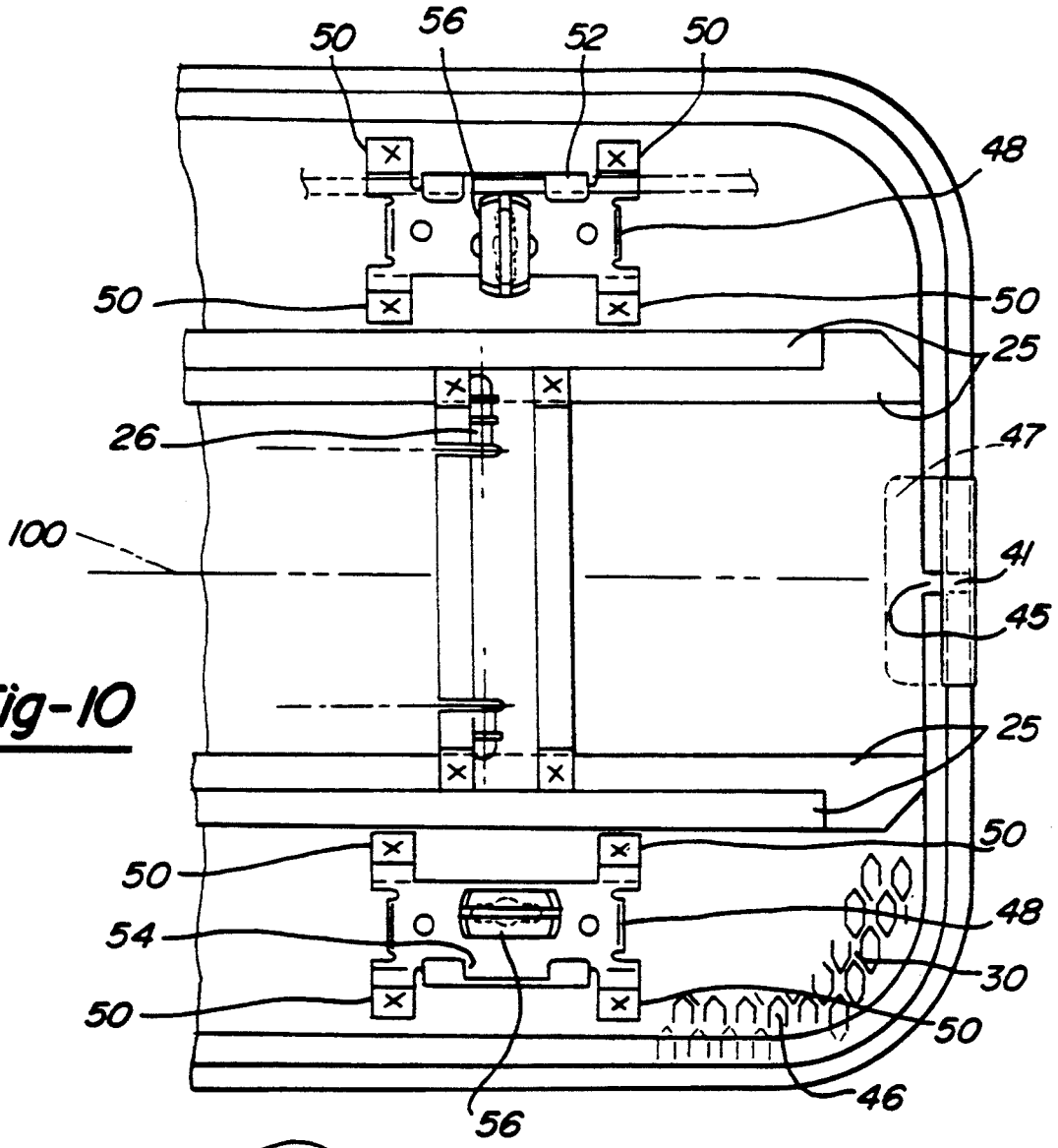
FIG. 10 is a bottom plan view illustrating shelf brackets welded onto the mesh central section of the ironing board.
Figure 11:
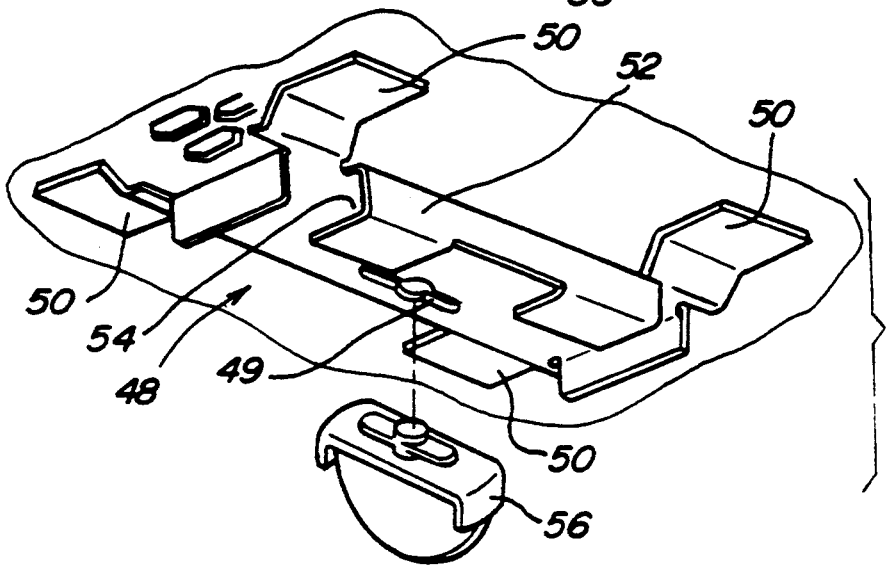
FIG. 11 is a perspective view of a shelf bracket shown in FIG. 10.

As shown in FIGS. 10 and 11, the lower surface 46 of the center section 38 has two brackets 48. The brackets have outer elevated pads 50 that are welded directly to the mesh 30. The brackets 48 also have outer downwardly extending flanges 52 that form a channel 54 that may receive a mount (not shown) for a plurality of attachment accessories such as a shelf. The bracket 48 has a slot 49 therethrough that may receive a lock buckle 56 that locks the mount in channel 54. The top lock buckle 56 shown in FIG. 10 is illustrated in the lock position while the bottom one is illustrated in the unlocked position. The brackets are illustrated near the rear end of the table 11. However the brackets 48 may be welded in any convenient or desirable position.

Figure 4:
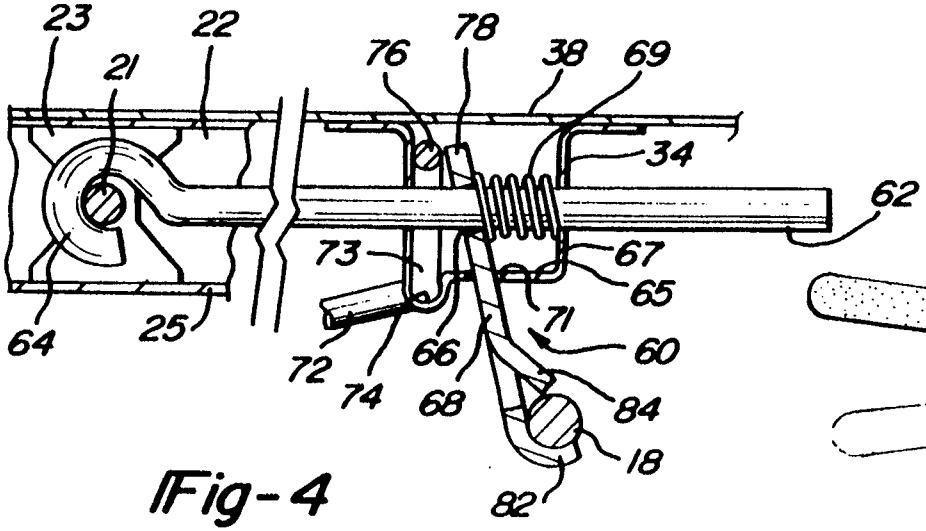
FIG. 4 is a fragmentary cross-sectional view taken along line 4—4 shown in FIG. 2 illustrating the lock mechanism.

The ironing table 11 includes a lock mechanism 60 for locking the legs 14 and 16 in a position extending from the top board 12 as shown in FIGS. 2 through 5. As shown in FIG. 4, the locking mechanism 60 includes an elongated control element 62 having a looped end 64 engaging the axle 21 affixed to the top ends 20 of the first legs 14. The control element 62 passes through an aperture 66 in a locking plate 68. When the legs 14 and 16 are between the closed lock position shown in FIG. 2 and a fully extended position as shown in FIG. 1, the locking mechanism 60 allows for passive movement of the looped end 64 in a direction toward the lock plate 68 thereby allowing unrestricted extensions of the legs 14 and 16 and locks the control element 62 against movement in an opposite direction which prevents the legs 14 and 16 from collapsing to the stored position as shown in FIG. 3. Helical spring 69 mounted about the control element 62 and interposed between wall 67 of frame 34 and plate 68 biases the plate to engage the control element 62 as shown in FIG. 4. The locking plate extends through a slot 71 through wall 65.

A release mechanism 70 includes handle 72 and a section 73 pivotably retained in a channel 74 formed in wall 65. A section 76 abuts a top section 78 of plate 68 such that when the handle is operated it pivots the plate against the spring 69 to release the control element 62 within aperture 66.

Figure 5:
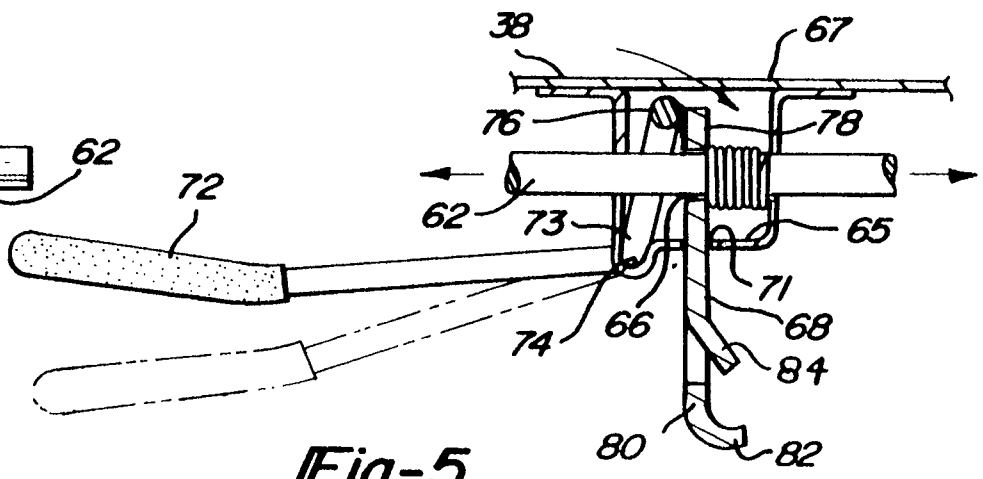
FIG. 5 is an view similar to FIG. 4 illustrating the lock mechanism in an unlock position.

The locking plate 68 has a lower section 80 with a hook end 82 that is engageable to the axle 18 when the legs are in the collapsed or stored position as shown in FIG. 4. The hook end 82 prevents the legs from undesirably extending when the ironing board is being transported. The operation of handle 72 disengages the hook end 82 from the axle to let the legs extend as shown in FIG. 5. The lock plate 68 also has a protrusion 84 spaced from the hook end and also is engageable with the axle 18 at an upper side when the legs are in the stored position. The engagement of the protrusion 84 with the axle 18 prevents the legs from further collapsing and undesirably abutting the frame 34. The protrusion 84 provides that the legs 14 and 16 may be maintained in a slightly spaced relationship with the frame 34 to form a gap 85 as shown in FIG. 3 when its in a fully collapsed position between the distal sections 17 and frame 34.

Figure 7:
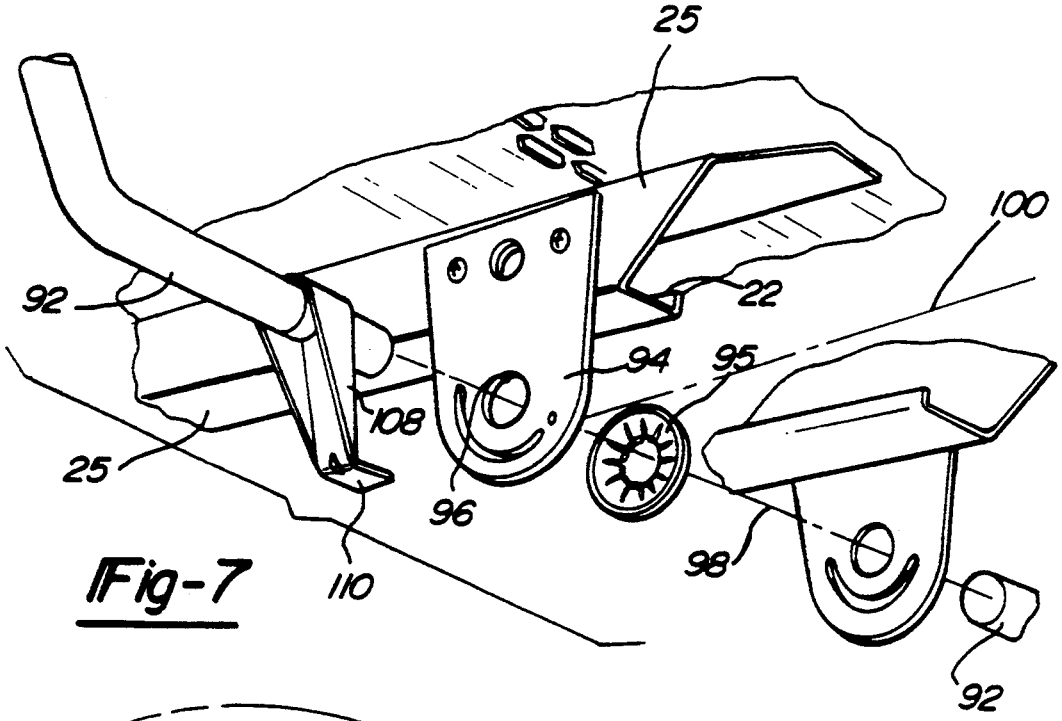
FIG. 7 is an exploded bottom perspective view illustrating the hanger rail brackets.

Referring now to FIGS. 7 and 8, a hanger rail 90 has two leg ends 92 mounted under the top board 12. Each leg end 92 is pivotably mounted to a bracket 94 that has an aperture 96 therethrough. A lock washer 95 prevents disengagement of the end 92 from aperture 96. The end is pivotable within aperture 96 about a axis 98 that is perpendicular to the longitudinal axis 100 of the top board 12 and is parallel to the top surfaces 42 and 44 of the mesh 30 and frame 34 respectively. As illustrated in FIG. 1, the hanger rail 90 has a hanger section 102 with hanger notches 104 for retaining a hanger hook therein. The hanger section 102 is affixed to the pivoting ends such that it may move from a stored position as shown in FIG. 3 against the top board 12 to a usable position as shown in FIGS. 1 and 3 (in phantom) beyond the end 106 of the top board.

The usable position is defined by stop limit brackets 108 affixed to the leg ends 92. The brackets 108 extend radially away from pivot axis 98 and has a distal bent end 110 that abuts a channel walls 25 under the mesh 30.

At each end of the hanger section 102 is an electric cord elevational device 114. The device 114 has a loop section 116 with an open slot 118 sized to let an electric cord 118 of an iron 120 to be squeezed therethrough into the aperture 122 through the loop section 116. The loop section 116 allows the electric cord to freely slide therethrough. The loop section by being at the hanger section 102 elevates the cord to keep it out of the way from interference with the clothes during ironing. The device 114 has an insert section 124 which telescopes into an end 126 of hanger section 102 and a second insert section 128 that telescopically fits into upper end 130 of leg section 132.

Variations and modifications are possible without departing from the scope and spirit of the present invention as defined by the appended claims.

The embodiments in which an exclusive property or privilege is claimed are defined as follows:

1. An adjustable ironing table having first and second legs moveable between a collapsed stored position adjacent a top board but not contacting said top board, and an open extended position away from said top board, said first and second legs pivotable with respect to each other about a pivot axle between said collapsed stored position and said open extended position, an elongated control element connected to one of said legs and slidably connected to said top board, a lock plate member interacting with said control element and moveable between a first release position which allows said legs to move toward either said collapsed stored position or said open extended position, and a second locked position which prevents said legs from moving toward said collapsed stored position, a first section of said lock plate member which when in the locked position, engages said pivot axle of said legs when in said collapsed stored position to prevent said legs from moving toward said open extended position, the improvement characterized by:

said lock plate member having a second section engaged with said axle to define said collapsed position and prevent said legs from further collapsing thereby preventing the distal sections of said legs from abutting said top board.

2. In an ironing table as defined in claim 1 further characterized by:

said first section of said lock plate member includes a lower flange section abuttable against a lower portion of said pivot axle to prevent said legs from moving toward said open extended position when said legs are in said collapsed stored position and when said lock plate member is in said second locked position;

said second section of said lock plate member includes an upper flange section abuttable against an upper portion of said axle to prevent said legs from further collapsing and to prevent distal sections of said legs from abutting said top board.

3. An adjustable ironing table having first and second legs moveable between a collapsed stored position adjacent to a top board and an open extended position away from said top board, said ironing table characterized by:

a hanger rail for clothing having at least one lower leg section pivotably connected to said ironing table under said top board, said at least one lower leg section pivotable about a pivot axis that is approximately perpendicular to a longitudinal axis of said top board and parallel to a plane surface of said top board;

said hanger rail also having a hanging rail section substantially transverse with a longitudinal axis of said board and affixed to the upper end of said at least one leg section for arcuate movement about said pivot axis between a stored position adjacent to said top board and a usable position beyond an end edge of said top board;

stop means under said top board operably connected to said at least one leg section for providing a limit stop for said leg section in order to secure said hanging rail section in said usable position.

4. The ironing table as defined in claim 3 further characterized by:

said stop means including a bracket affixed to said at least one leg section, extending approximately perpendicular away from said pivot axis; and a distal end of said bracket abuttable against a longitudinally extending channel rail affixed under said top board in order to secure said hanging rail section in said usable position.

5. An ironing table as defined in claim 3 further characterized by;

a cord elevation device mounted in proximity to said hanging rail section and sized to slidably receive an electric cord of an iron.

6. An ironing table as defined in claim 5 further characterized by:

said cord elevation device including a loop element affixed to a side of said hanging rail section;

said loop element having an opening sized to allow said electric cord of said iron to be squeezed therethrough;

said loop element having a central aperture sized to slidably receive said electric cord.

7. An ironing table as defined in claim 6 further characterized by:

said hanging rail section having opposing ends and a cord elevation device is affixed to each end of said hanging rail section.

* * * * *